US005571035A

United States Patent [19]

Ferrill

[11] Patent Number: 5,571,035

[45] Date of Patent: Nov. 5, 1996

[54] DIVERGENT LOAD BAR

[75] Inventor: Jess B. Ferrill, Madison, N.C.

[73] Assignee: The Whitaker Corporation, Wilmington, Del.

[21] Appl. No.: 332,218

[22] Filed: Oct. 31, 1994

[51] Int. Cl.[6] ..... H01R 9/22

[52] U.S. Cl. ..... 439/894; 439/676

[58] Field of Search ..... 439/676, 607, 439/894, 894.1, 928, 929, 660, 719

[56] References Cited

U.S. PATENT DOCUMENTS

| | | | |
|---|---|---|---|
| 4,577,920 | 3/1986 | Coldren et al. | 339/143 R |
| 4,601,530 | 7/1986 | Coldren et al. | 339/103 M |
| 4,713,023 | 12/1987 | Bixler et al. | 439/393 |
| 4,767,355 | 8/1988 | Phillipson et al. | 439/425 |
| 4,975,078 | 12/1990 | Stroede et al. | 439/676 |
| 4,978,316 | 12/1990 | Yahata | 439/676 |
| 5,147,215 | 9/1992 | Pritulsky | 439/344 |
| 5,179,779 | 1/1993 | Iura et al. | 29/887 |
| 5,415,567 | 5/1995 | Fusselman et al. | 439/719 |

FOREIGN PATENT DOCUMENTS

| | | | |
|---|---|---|---|
| 0226779 | 7/1987 | European Pat. Off. . | |
| 0238316 | 9/1987 | European Pat. Off. . | |
| 0315763 | 5/1989 | European Pat. Off. . | |
| 2266430 | 10/1975 | France . | |
| 2523774 | 9/1983 | France . | |
| 2249222 | 4/1992 | United Kingdom | H01R 9/07 |

*Primary Examiner*—David L. Pirlot

[57] ABSTRACT

This disclosure relates to a high performance electrical connector, such as a modular plug, for example, used in high frequency data transmission systems, where such connector is intended to be mated to a receptacle type connector. The modular plug comprises a dielectric housing having a conductor receiving end, a conductor terminating end, a passageway communicating internally between the respective ends, and a spacing or insert in the passageway to receive and/or separate a plurality of conductors and to position them in a manner to improve the crosstalk performance of the modular plug. A preferred insert is characterized by having an upper surface and a lower surface to space or separate selected pairs of the conductors. Within the limits of the housing, the insert or spacing maximizes the separation of the selected pairs and arranges them in plural planes before being realigned into a common plane for termination at the conductor terminating end. Several alternative embodiments for the insert are disclosed, ranging from solid bodies to spacing members which may be removable.

4 Claims, 5 Drawing Sheets

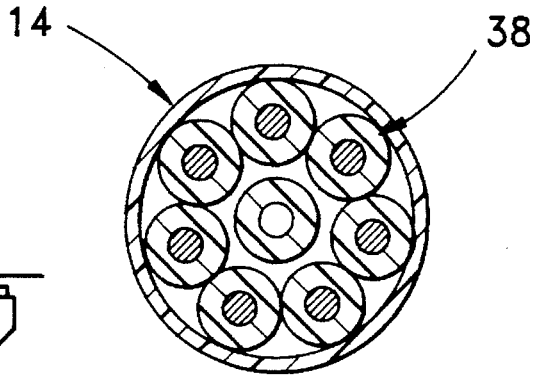
Fig. 3
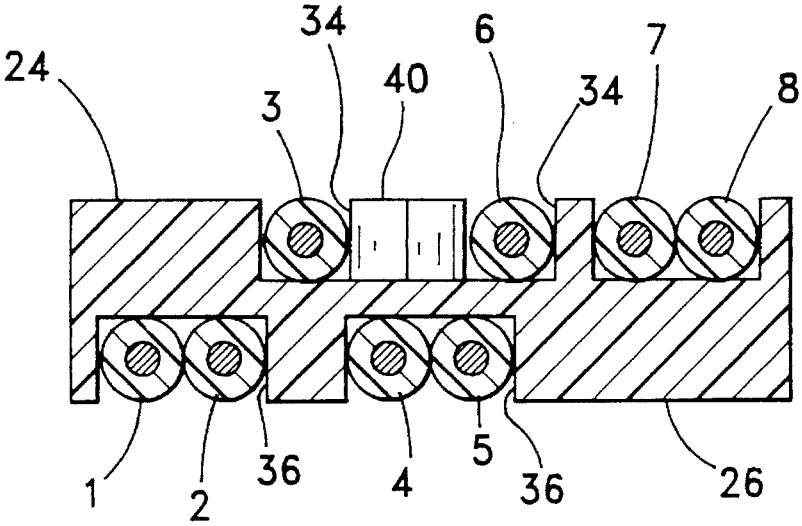
Fig. 4
Fig. 5
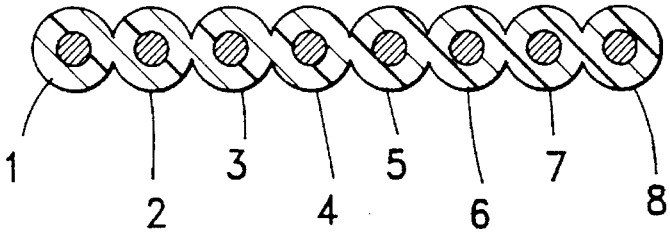

DIVERGENT LOAD BAR

BACKGROUND OF THE INVENTION

This invention is directed to a divergent or load bar insert, wire organizer, or manager for use in positioning and aligning a plurality of electrical conductors in a modular plug, for example, where such insert, by its unique arrangement of conductors, offers significantly improved crosstalk performance to the modular plug.

While the invention has particular relevance to a modular plug, it will be understood that it has applicability to other electrical connectors, where higher performance through reduced crosstalk is desirable and necessary. A current standard or performance level used today is identified as Category 5 products, where operating frequencies may be 100 MHz or higher.

For convenience, the further description will be directed to the field of modular plugs, a product well known in the art, and the applicability of the invention hereof as it relates to the enhanced performance of a modular plug. Modular plugs, a relatively inexpensive electrical connector, are used extensively in telephonic and other data communication systems. Frequently such plugs must be terminated in the field by technicians, or manually in a factory by assembly personnel. Typically the cable to be terminated in the plug is a bundle of four twisted pair, insulated, multi-colored wires (eight in total) within a cable jacket or wrap of an insulating sheath. The bundle may optionally include a drain wire or surrounding shield for use in a shielded plug. In any case, to prepare the cable for eventual termination in the plug, the cable jacket is peeled back to expose the various insulated pairs. Thereafter, with the several insulated wires exposed, the wires are untwisted and arranged in the desired order, generally in a side-by-side fashion. The wires are then individually inserted into the connector housing and terminated by an insulation piercing blade, a termination procedure known in the art. Because this loading process is so time consuming in the factory, cost effective procedures had to be developed to speed up the process. The result was the development of wire organizers.

Loading bar inserts, or wire organizers, have been known for several years, as exemplified by U.S. Pat. No. 4,713,023. The invention thereof includes a wire positioning means for holding insulated conductors in an array so that the ends thereof are presented in alignment below terminal receiving cavities when the wire loaded positioning means is in the housing. The positioning means includes cam means formed thereon and adapted to engage a housing strain relief section when it is moved downwardly, whereby the positioning means is moved forwardly in the housing to fully seat the positioning means therein and position the free ends of the insulated conductors below the terminals. There is no reference therein to aligning the insulated conductors in plural planes prior to the termination thereof.

In UK Patent Application NO. 2 249 222 A, assigned to the assignee hereof, there is taught an electrical connector and insert therefor, where the invention relates to a plastic insert for such connector and has a row of wire guiding mouths each for guiding an individual wire into a passageway as the cable is inserted into the connector. The cable has at least one wire less than the number of the passageways and the insert has at least one solid blanking-off portion for blanking off the single or plural unused passageways. The wire guiding mouths of the insert are defined by at least one longitudinal opening having scalloped longitudinal edges. Again, there is no reference to improving crosstalk performance by altering the conductor paths within the connector.

U.S. Pat. No. 4,601,530, assigned to the assignee hereof, teaches a preloaded wire organizer for a modular type plug. Specifically, the patent teaches the process of preloading wires into a wire holder which locates the leading ends of the wires at the same pitch as passageways in the connector housing. The wire holder supported by the wires, is then inserted into and along a mouth of the housing until it abuts a tapered throat at the entrance to the passageways. Further advance of the bundle feeds the discrete wires through the wire holder into the respective passageways guided by the throat, while the wire holder remains adjacent the tapered throat.

All these prior art systems were guided by the primary need to speed up field termination. There was clearly no recognition of the later need to improve performance of the connectors. Recently, Stewart Connector Systems, Inc. of Glen Rock, Pa., introduced a Category 5 performing modular plug utilizing a sliding wire management bar, where such bar contains two rows, each with four through holes, to receive the standard eight wires of a cable. To use the management bar, the user is advised to arrange the wires in two equal sets, and cut each set of four at a 45° angle such that no two wires are of the same length. With the prepared wires, the wires are individually fed into the holes of the wire organizer, in sliding engagement therewith, than trimmed to the same length. For the loading step, the wire organizer is first pushed to the end of the trimmed wires, then inserted into the connector housing. In the fashion of U.S. Pat. No. 4,601,530, when the wire organizer can no longer move forward, the wires are pushed beyond the wire organizer into a position to be individually terminated, as known

BRIEF DESCRIPTION OF DRAWINGS

FIG. 3 is a sectional view of a prior art cable, taken along line 3—3 of FIG. 1, showing plural conductors prior to a planar arrangement thereof for entry into the load bar of FIG. 2.

FIG. 4 is a sectional view of a preferred load bar of this invention, taken along line 4—4 of FIG. 1.

FIG. 5 is a sectional view, taken along line 5—5 of FIG. 1, showing the realigned conductors in a planar relationship for entry into a modular plug, for example, prior to termination therein.

DETAILED DESCRIPTION OF PREFERRED EMBODIMENTS

Figures 1, 2:
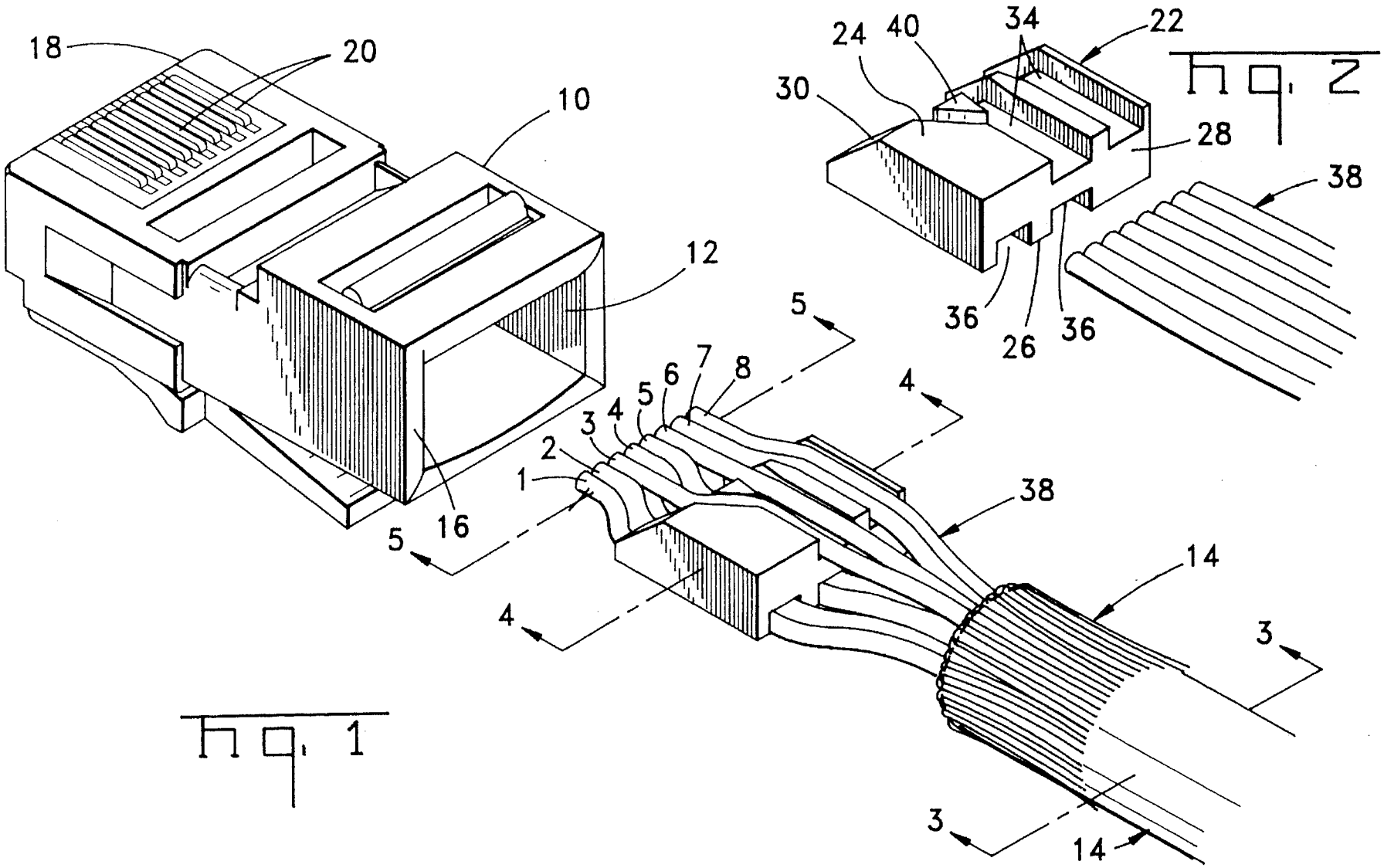
FIG. 1 is an exploded perspective view of a preferred embodiment of a divergent load bar according to this invention, where such load bar is illustrated in an environment in which it may be used.
FIG. 2 is a perspective view of the divergent load bar of FIG. 1, illustrating a pre-loading condition thereof.

The present invention relates to a uniquely designed load bar insert, separation, or mechanism for use in an electrical connector, such as a modular plug, to improve the crosstalk performance of such connector. in the art. While claiming to provide Category 5 performance, the assembly and termination of the modular plug is very labor intensive.

The present invention adds a new dimension to improving the crosstalk performance of modular plugs by the provision of an insert or means for conventionally available modular plug housings that are user friendly to assemble, and which will achieve consistent Category 5 performance. The manner by which the improved performance is achieved will be apparent in the specification which follows, particularly when read in conjunction with the accompanying drawings.

SUMMARY OF THE INVENTION

The invention is directed to a high performance electrical connector, such as a modular plug, for example, used in high frequency data transmission systems, where such connector is intended to be mated to a receptacle type connector. The modular plug comprises a dielectric housing having a conductor receiving end, a conductor terminating end, a passageway communicating internally between the respective ends, and a spacing or insert in the passageway to receive or separate a plurality of conductors and to position same in a manner to improve the crosstalk performance of the modular plug. A preferred insert is characterized by having an upper surface and a lower surface to space or separate selected pairs of the conductors. Within the limits of the housing, the insert or spacing maximizes the separation of the selected pairs and arranges them in plural planes before being realigned into a common plane for termination at the conductor terminating end. A first embodiment includes grooves in the upper and lower surfaces of the insert, while a second embodiment is directed to a spacing rod like member, such as may be made of an elastomer, plastic, or plastic-like tube. A typical connector illustrated in FIG. 1, comprises an insulating housing 10 formed with a mouth 12 for receiving a multi-wire electrical cable 14 and opening into a rear end 16 of the housing and communicating internally thereof with a row of cable wire receiving passageways. The passageways extend towards a front end 18 of the housing in alignment with respective electrical terminals 20 thereof. By way of further understanding, the multi-wire electrical cable 14, shown in section in FIG. 3, is characterized as twisted pair cable, where preferably selected pairs of wires are twisted together. That is, a typical cable for an 8-position modular plug will reveal four twisted pairs of insulated wires. By way of further example, under specification TIA/EIA-568A, a preferred pairing arrangement of conductors or wires for the modular plug terminal numbers are as follows: 1-2, 3-6, 4-5, and 7-8. This will be discussed in more detail hereinafter. Nevertheless, it should be noted that under prior art practices it was believed that in the preparation and termination of the wires in a modular plug, the "½ inch untwist" rule had to be followed. That is, the twisted pairs had to remain twisted except for about ½ inch of the end of each of wire to effect termination. It was discovered that such rule for modular connectors can be violated by the practice of this invention without suffering an increase in Near End Crosstalk (NEXT). A critical factor is that the physical separation of the interfering pairs (primarily the 3-6 pair which is split around the 4-5 pair in the center of the plug) is more important than maintaining a tight twist. Crosstalk is inversely proportional to the distance between the interfering wires.

Figure 6:
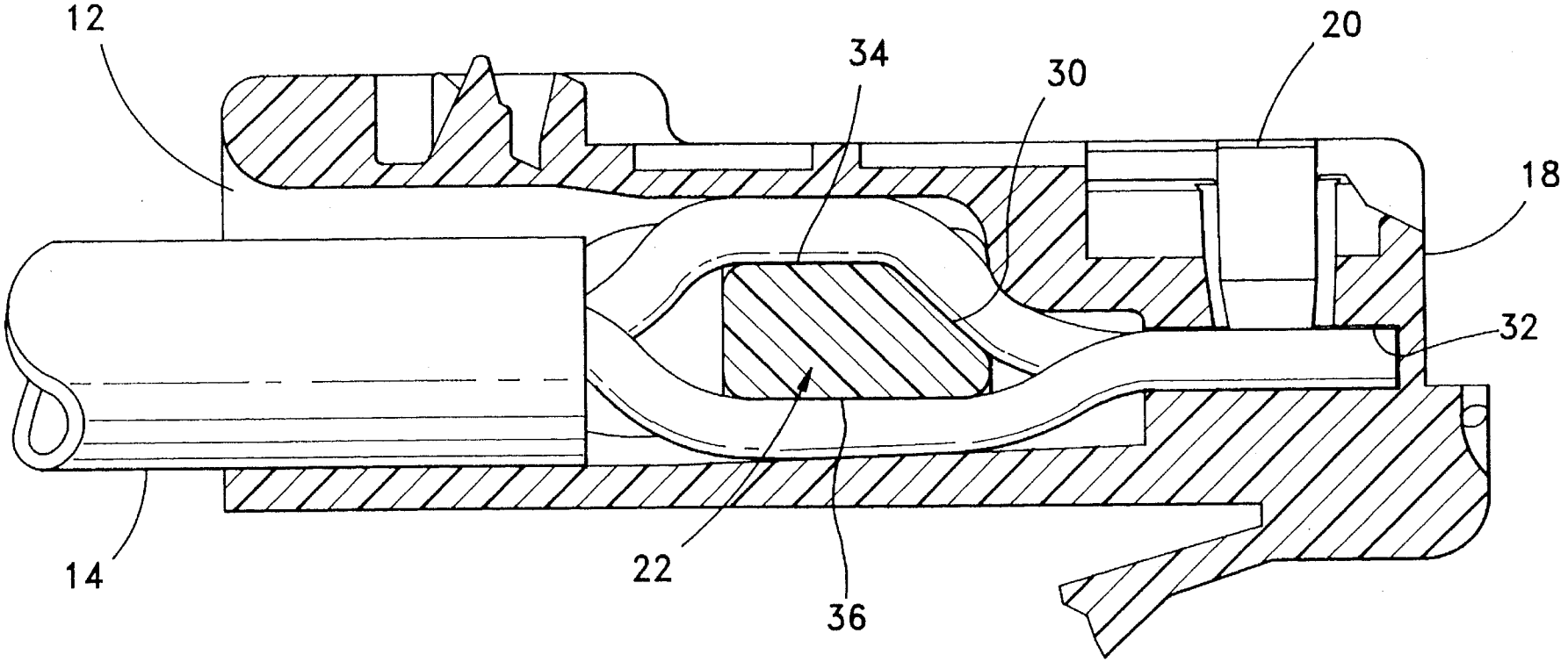
FIG. 6 is an enlarged longitudinal sectional view taken through a terminated modular plug with the load bar mounted therein.

Continuing with the various FIGS., FIG. 2 illustrates a first embodiment of a load bar insert 22, adapted to be slidable received through mouth 12 within the housing 10. This insert, formed from a dielectric material, such as plastic, includes upper and lower surfaces 24, 26, respectively, a back 28, and a tapered or divergent forward surface 30, where as illustrated in FIG. 6, directed to the cable receiving passageway 32 underlying the conductor terminating blades or terminals 20 see FIG. 6. Along the respective upper and lower surfaces 24, 26, are pairs of slots or grooves 34, 36, respectively, into which selected pairs of wires 38 are received. To carry on with the pairing arrangement above, pairs 3-6 and 7-8 are seated within upper slots 34, while the remaining two pairs are seated within lower slots 36. Note further that the upper slot containing pair 3-6 may include an end divider 40, see also FIG. 4, to separate and align the wires into their numerically assigned position (FIG. 5) for termination. By providing for the upper and lower slots, separation of the wires is maximized within the housing 10. Further, by providing for the forward or diverging surface 30, the respective wire pairs along the upper surface 24 are in multiple planes before returning to a single plane, as shown in FIG. 5. These factors contribute significantly to the improved performance of the plug, since crosstalk is reduced by increasing the wire separation distance.

Figure 7:
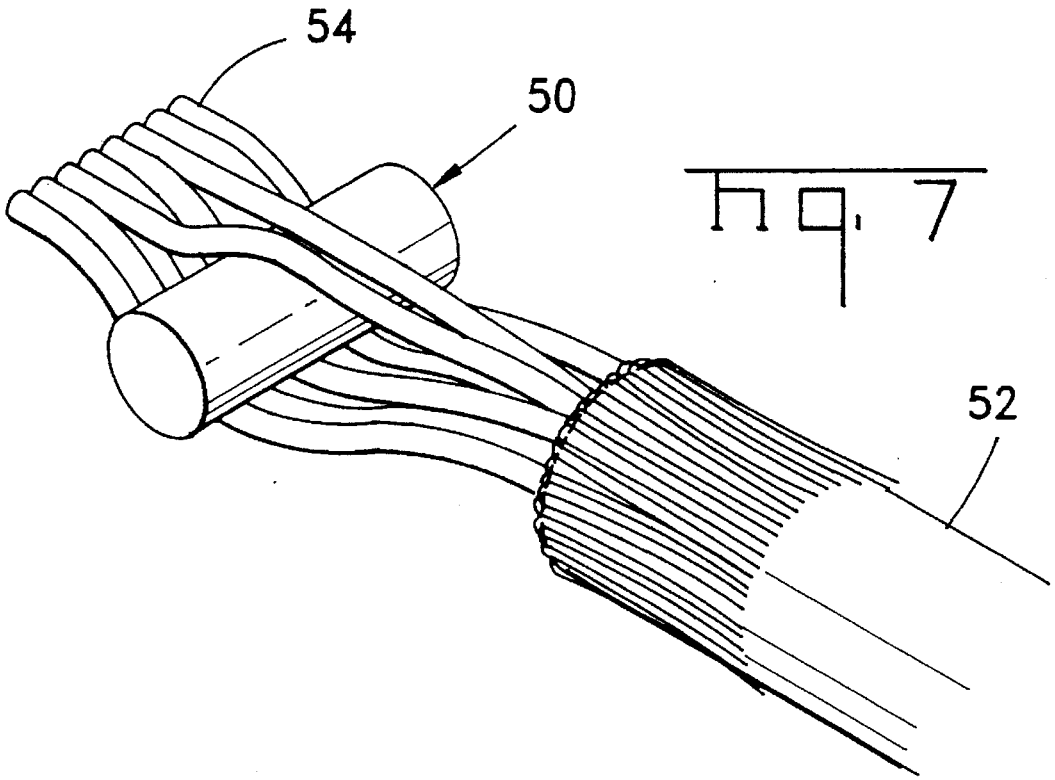
FIG. 7 is a perspective view of a second embodiment for a load bar, where such load bar is optionally removable.
Figure 8:
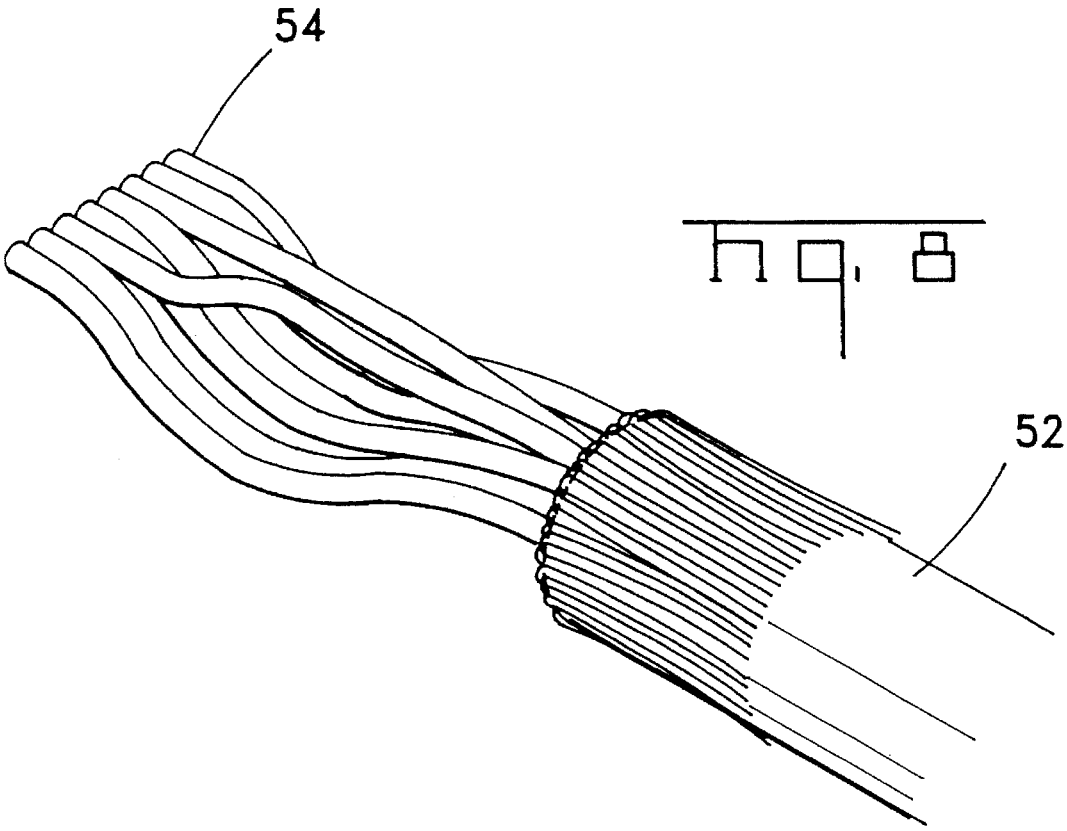
FIG. 8 is a perspective view similar to FIG. 7, showing a third embodiment where no insert is used, but rather a spacing is provided with the wires arranged for separation.
Figure 9:
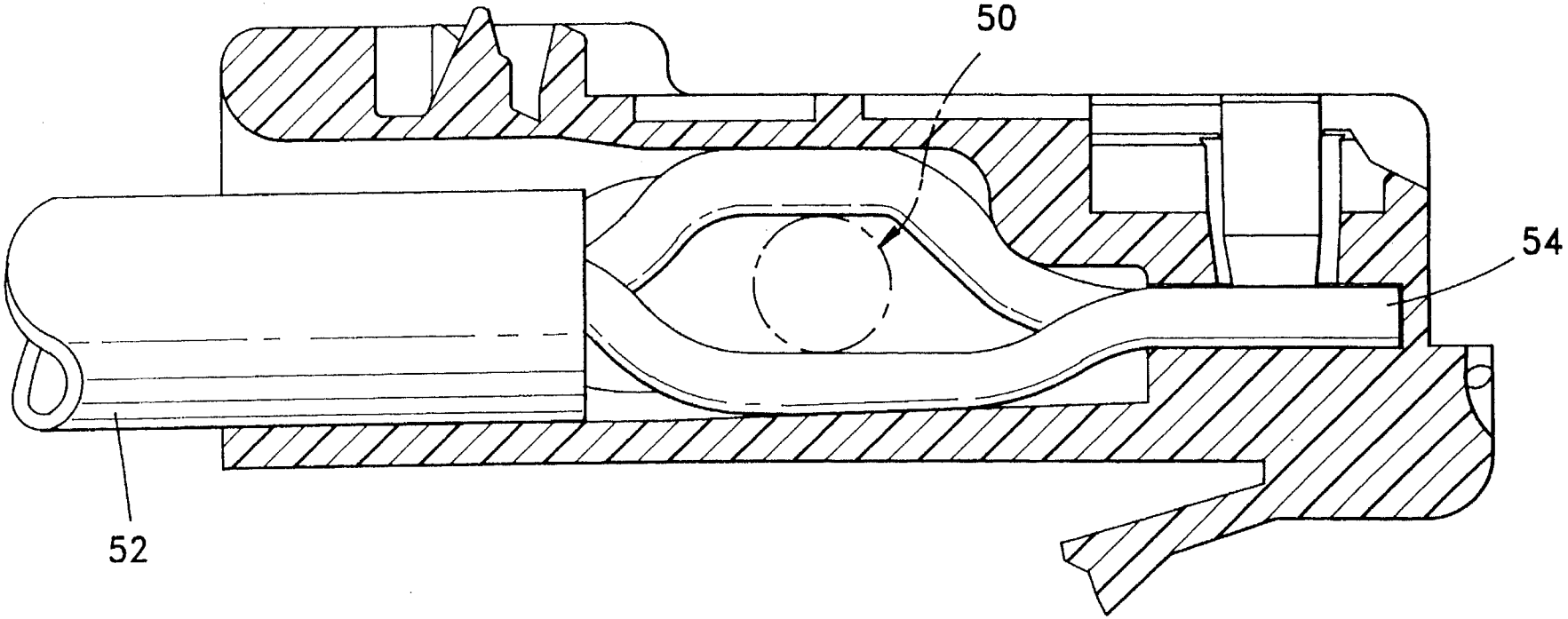
FIG. 9 is an enlarged, longitudinal sectional view, similar to FIG. 6, showing in phantom lines the position of the load bar of FIGS. 7 and 8.

A second embodiment for a load bar insert 50 is illustrated in FIGS. 7–9. With the primary purpose of the insert being to space-apart the wires into multiple planes prior to realignment for purposes of termination, this new insert satisfies well such purpose. The insert 50 comprises a spacing member, which may be an elastomer, styrofoam, or plastic cylinder, where the selected pairs of wires are placed either over the top or under the bottom. In the illustration of FIG. 7, the critical pair 3-6 is along the top while the remaining pairs are below the insert. Specifically, in the different embodiments the wire divergence pattern is varied. However, a common thereof is the provision that the critical pairs 3-6 and 4-5 are separated. By the use of a spacing member, the wires, when inserted into the connector housing, are maintained at a spacing to minimize crosstalk.

With the two embodiments illustrated in the several Figures, it will be seen that after the wires engage the insert 22, 50, the respective wires, in the desired sequence, converge from their respective planes to a common plane for termination. It was discovered that insertion of a unitary braid of side-by-side wires could more easily be inserted into the passageways of a connector housing than a number of discrete wires. This recognition led to a wire bonding technique that is the subject of U.S. Patent Application (Attorney Docket 16013), filed concurrently by one of the inventors of this invention, where such application is incorporated herein in its entirety. Very briefly, the method thereof comprises the steps of aligning plural insulated conductors in side-by-side fashion on a first fixture, where the fixture may include a plurality of heating elements, with each heating element arranged to contact the insulation jackets of an adjacent pair of conductors. Thereafter, aligning a second fixture of comparable design and function in sandwich fashion to the opposite sides of the insulation jacketed conductors, and applying electrical current to the heating elements to effect a localized melting and bonding of the insulation jackets of adjacent conductors to one another. In this manner, or other method of bonding, a unitary ribbon type cable for ease of handling and termination is formed. A feature of this method is a shape change in the profile of the bonded wires which helps to avoid stubbing into the housing passageway for termination of the wires.

An unexpected advantage attributed to the combination of the inventions of the co-pending application and the present invention is that the wires after bonding are relatively fixed to one another. This advantage may be best illustrated by FIG. 8 where the rod or cylindrical like insert 50 has been removed. Since the wires are fixed in position at the respective ends, i.e. within cable 52 and bonded zone 54, the wires will not resile into a common plane as would be expected with only one fixed end. Thus, the wires when bonded, such as by the method of the co-pending application, may be readily inserted into the connector as discussed above. FIG. 9 illustrates the relative position of the wires with or without the insert 50.

I claim:

1. An electrical connector of the plug assembly type for mating with a receptacle type connector, where a plurality of conductors which are associated as signal pairs are terminated therein for electrical engagement with corresponding contacts in said receptacle connector, and said signal pairs are susceptible to electrical crosstalk, said plug assembly comprising:

a dielectric housing having a conductor receiving end, a conductor terminating end, a passageway communicating internally between said respective ends, and a spacing insert in said passageway, said insert having an upper surface and a lower surface with plural grooves arranged along said surfaces generally parallel to said passageway, said grooves being spaced apart and configured to receive respective ones of said signal pairs in different ones of said grooves, whereby separation of said signal pairs reduces crosstalk therebetween.

2. The electrical connector according to claim 1 wherein a tapered wall extends from one toward the other of said upper and lower surfaces at said conductor terminating end, whereby said signal pairs along said one surface are directed toward the signal pairs along said other surface.

3. The electrical connector according to claim 2 wherein free ends of said conductors are arranged in a parallel manner in a common plane at said conductor terminating end.

4. The electrical connector according to claim 3 wherein said free ends are bonded together to form a unitary, ribbon cable.

* * * * *